US005235760A

United States Patent [19]

Bastien

[11] Patent Number: 5,235,760

[45] Date of Patent: Aug. 17, 1993

[54] HAIR DRYER WITH BLOWER AND RADIANT HEATING MODES OF OPERATION

[76] Inventor: Ernest J. Bastien, 977 Lincoln Ave., Benicia, Calif. 94510

[21] Appl. No.: 811,735

[22] Filed: Dec. 23, 1991

[51] Int. Cl.[5] ..... A45D 20/24

[52] U.S. Cl. ..... 34/99

[58] Field of Search ..... 34/96, 99, 100

[56] References Cited

U.S. PATENT DOCUMENTS

| | | | |
|---|---|---|---|
| 1,765,379 | 6/1930 | McGinnis | 34/99 |
| 1,998,198 | 4/1935 | Leland | 34/99 |
| 3,469,328 | 9/1969 | Handler et al. | 34/99 |
| 3,512,809 | 5/1970 | Marhanka | 285/189 |
| 3,513,563 | 5/1970 | Ziegler | 34/99 |
| 3,600,821 | 8/1971 | Simon, Jr. | 34/99 |
| 3,731,396 | 5/1973 | McLean | 34/99 |
| 3,822,484 | 7/1974 | Reed | 34/99 |
| 3,835,551 | 9/1974 | Keimpema et al. | 34/99 X |
| 3,999,305 | 12/1976 | Driessen et al. | 34/99 |
| 4,323,761 | 4/1982 | Hubner | 219/354 |

FOREIGN PATENT DOCUMENTS

| | | | |
|---|---|---|---|
| 195051 | 5/1957 | Sweden | 34/99 |

*Primary Examiner*—Harold Joyce
*Attorney, Agent, or Firm*—Harris Zimmerman

[57] ABSTRACT

A hair dryer of the type having a hood in which a heated air flow is directed to the upper portion of a person's head includes components for selectively blocking air flow to the person's head and for concurrently venting the blocked air flow at a location outside of the interior of the hood. Components of the hood continue to be heated by the diverted air flow and radiate heat to the person's hair in the manner of a heat lamp. This enables use of the dryer for other hair processing operations, such as tinting for example. A separate radiant heater is not needed and hair dressing procedures are simplified.

13 Claims, 4 Drawing Sheets

HAIR DRYER WITH BLOWER AND RADIANT HEATING MODES OF OPERATION

TECHNICAL FIELD

This invention relates to hairdressing apparatus and more particularly to hair dryers of the type having a hood for receiving the upper portion of a person's head and in which a flow of heated air may be directed to the person's hair.

BACKGROUND OF THE INVENTION

Professional hairdressing salons are typically equipped with one or more hair dryers having a hood, an air heater and means for directing a flow of heated air to the patron's head to accelerate the drying process. The dryer air flow causes movement of hair and also dries hair at a rapid rate. These effects are not appropriate during certain hair processing procedures. As one example, hair tinting calls for the application of heat without physical disturbance of the hair and the solutions that are used in the process should not be rapidly dried up. Consequently, other items of equipment such as radiant heat lamps are used for hair processing operations of this type.

Use of separate dryers and heat lamps has an adverse impact on costs, space requirements and also complicates the hairdressing operations as the patron must move from one location to another or the hairdresser must move bulky equipment from one location to another. It would be advantageous to reduce the amount of equipment that is required for hairdressing operations and to do so without substantial structural complication of the remaining equipment. It would also be advantageous to make use of pre-existing hair dryers for other hair processing procedures without requiring complicated modifications of the structure of the dryers.

The present invention is directed to overcoming one or more of the problems discussed above.

SUMMARY OF THE INVENTION

In one aspect, the invention provides hair drying apparatus having a hood with a dome shaped chamber adapted to receive the upper portion of a person's head and having a heated air compartment situated outward from the chamber and having means for delivering a flow of heated air from the compartment to the chamber. The apparatus further includes flow control means for selectively blocking at least a portion of the heated air flow from the chamber and exhaust means for venting the blocked air flow from the hood at a location that is outside of the chamber. This enables selective suppression of air flow to the person's hair while the hood continues to be heated by the air flow and operates as a radiant heater for hair processing operations.

In another aspect, the invention provides hair drying apparatus which includes a hood having an outer wall and an inner wall which is spaced from the outer wall to form a heated air compartment therebetween and to form a chamber in the hood for receiving the upper portion of a person's head. The inner wall has a plurality of spaced apart apertures situated at different locations around the chamber for transmitting a flow of heated air from the compartment to the chamber and is turnable relative to the outer wall. The outer wall has a plurality of inwardly directed projections located to close the apertures when the inner wall is turned to a first position and to open the apertures when the inner wall is turned away from that position. The apparatus further includes means for delivering a flow of heated air to the compartment and means for venting heated air from the compartment at a location outside of the head receiving chamber when the inner wall is turned to the first position.

In another aspect of the invention, hair drying and processing apparatus includes a hood having an outer wall and an inner wall spaced apart from the outer wall to form a heated air compartment therebetween and to form a chamber in the hood for receiving the upper portion of a person's head. The inner wall has a plurality of spaced apart apertures for transmitting a heated air flow from the compartment to the chamber and has at least one heated air vent passage extending from the compartment to a location that is outside the chamber. An inner liner is disposed within the hood in contact with the inner wall of the hood and is turnable relative to the inner wall. The liner has a plurality of openings located to register with the apertures of the inner wall when the liner is turned to a first position and to be out of register with the apertures when the liner is turned away from that position. The liner has an extension positioned to close the heated air vent passage of the hood when the liner is turned to the first position.

In another aspect, the invention provides hair drying and processing apparatus which includes a hood having an inner wall spaced apart from an outer wall to form a heated air compartment therebetween and which forms a chamber in the hood for receiving the upper portion of person's head. The inner wall has a plurality of spaced apart apertures situated at different locations around the chamber for transmitting a flow of heated air from the compartment to the chamber. A removable air flow impervious inner liner is disposed in the hood in spaced apart relationship with the inner wall for selectively intercepting the flow of heated air. The liner has a flange which extends outwardly beneath the lower rim of the hood to direct the intercepted air flow to a location which is outside of the head receiving chamber.

In still another aspect, the invention provides a removable liner for a hair dryer of the type having a hood with a chamber for receiving the upper portion of a person's head and which has an apertured inner wall through which a flow of heated air is is directed to the person's hair. The liner has a dome shaped configuration and is proportioned to fit into the chamber in spaced apart relationship with the inner wall. The liner is formed of air flow impervious material and has a flange located to extend outwardly beneath the hood. The liner intercepts the heated air flow and directs it to a location outside the head receiving chamber. The liner is heated by the intercepted flow and operates to radiate heat towards the upper portion of the person's head.

The invention enables use of heated air flow generating hair dryers for hair processing operations other than blow drying of hair. The dryer has an alternate mode of operation at which air flow to the hair is suppressed or eliminated and the dryer functions as a radiant heater in the manner of a heat lamp. This makes the dryer usable for hair processing operations of the type in which the hair should not be physically moved and/or in which hair processing liquids should not be rapidly dried up. This is accomplished without requiring inclusion of additional heat sources for the radiant heating mode. By extending the functional capabilities of hair dryers, the invention enables savings in the cost of equipping a hair-dressing salon, reduces the space required for hair processing equipment and simplifies hairdressing procedures.

DETAILED DESCRIPTION OF THE PREFERRED EMBODIMENTS

Figure 1:
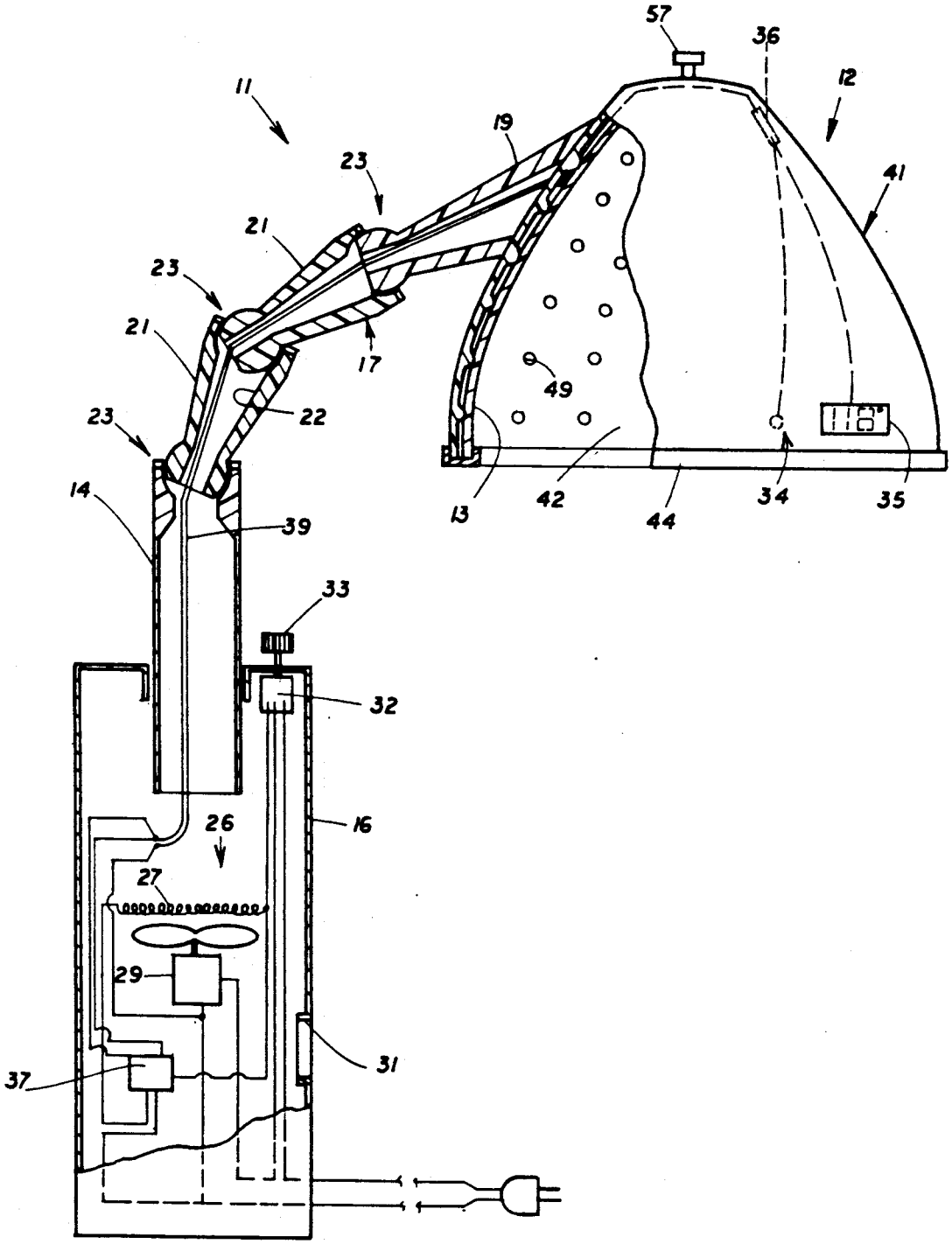
FIG. 1 is an elevation view of a hair dryer and processor in accordance with a first embodiment of the invention with portions of the apparatus being shown in section and with certain electrical components being depicted schematically.

Referring initially to FIG. 1 of the drawings, a hair dryer and processor 11 in accordance with a first embodiment of the invention has a generally dome shaped hood 12 forming a hair drying and processing chamber 13 which is open at the bottom and which is proportioned to receive the upper portion of a person's head.

Hood 12 may be supported in any of a variety of ways and in the present example is attached to a tubular post 14, that extends upward from a rectangular base housing 16, through an articulated gooseneck 17 that enables adjustment of the height and angling of the hood. Gooseneck 17 in this embodiment is formed by an arm 19 which extends from the hood 12 and a pair of links 21 all of which have a through axial passage 22 to enable heated air to flow from base housing 16 to the interior of the hood. Referring jointly to FIGS. 1 and, 2A, links 21 are coupled together and to arm 19 and post 14 by ball and socket joints 23 which enable pivoting movement at each such coupling. To maintain the hood 12 at a selected elevation and orientation, screws 24 exert sufficient clamping pressure on each joint 23 to immobilize the joint except when it is being forcibly articulated by an operator or by a person whose hair is being treated.

Referring again to FIG. 1 in particular, base housing 16 contains means 26 for delivering a flow of heated air to hood 12 which components are shown in schematic form in the drawing as they may be similar to the corresponding components of a conventional hair dryer. Such means 26 typically include an electrical heating element 27 and an electrical motor driven fan or blower 29 that directs a flow of air past the heating element. The fan 29 is positioned to draw the air flow into housing 16 through an intake opening 31 near the base of housing 16 and to direct the heated air flow into post 14 and thus into hood 12 through the hollow gooseneck 17. A control switch 32 has a control knob 33 situated at the exterior of housing 16 and enables the operator to selectively energize heating element 27 and fan 29. Such control switches are preferably of the multiple position type that enable application of any of several voltage levels to heating element 27 and fan 29 to enable selection of different degrees of heating and air flow rate within hood 12. Although it is not essential, the switch 32 is preferably one which has an additional setting or position which is selected during the radiant heating mode of operation and at which the heating element current is higher than at other settings to provide a hotter air flow. Preferably, switch 32 energizes a "Processing On" indicator light 34 when it is at the additional setting which indicator may be located at the exterior surface of hood 12. It is also advantageous to the hairdresser if a thermometer 35 is present at a visible location on hood 12, the thermometer in this example being a digital display responsive to the signal from a temperature sensor 36 that is situated within hood 12.

A thermostat 37 is preferably connected in series with heating element 27 and responds to the signal from temperature sensor 36 by varying the current in the heating element when necessary to maintain the temperature within the hood at the level which has been selected at switch 32.

The electrical connections between the temperature sensor 36 and thermostat 37 and power leads for indicator light 34 and temperature display 35 may be made by means of a multi-conductor electrical cable 39 which extends within the interior passage 22 of gooseneck 17. Cable 39 has a diameter that is substantially smaller than the diameter of the passage 22 and thus does not significantly impede air flow through the passage.

Figure 2:
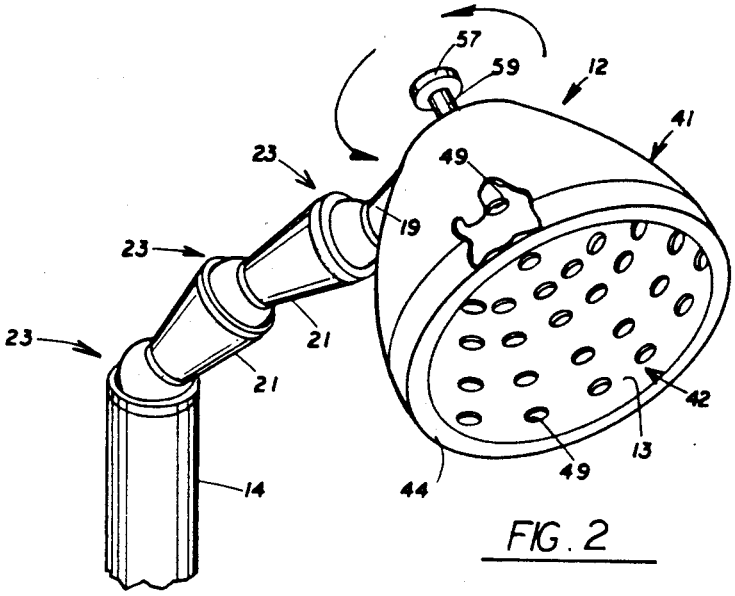
FIG. 2 is a partially broken out perspective view of the upper portion of a hair dryer and processor in accordance with the first embodiment of the invention.
Figure 2A:
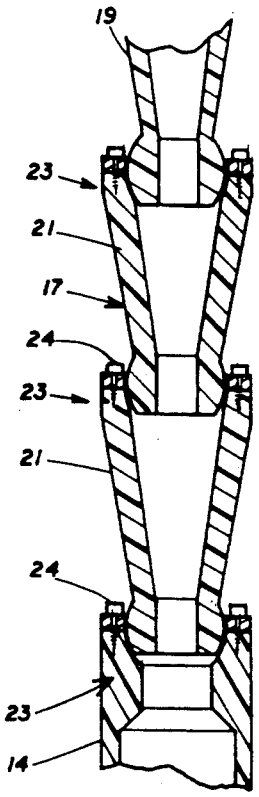
FIG. 2A is an axial section view of an articulated hood support arm of the hair dryer and processor of FIG. 2.
Figure 3:
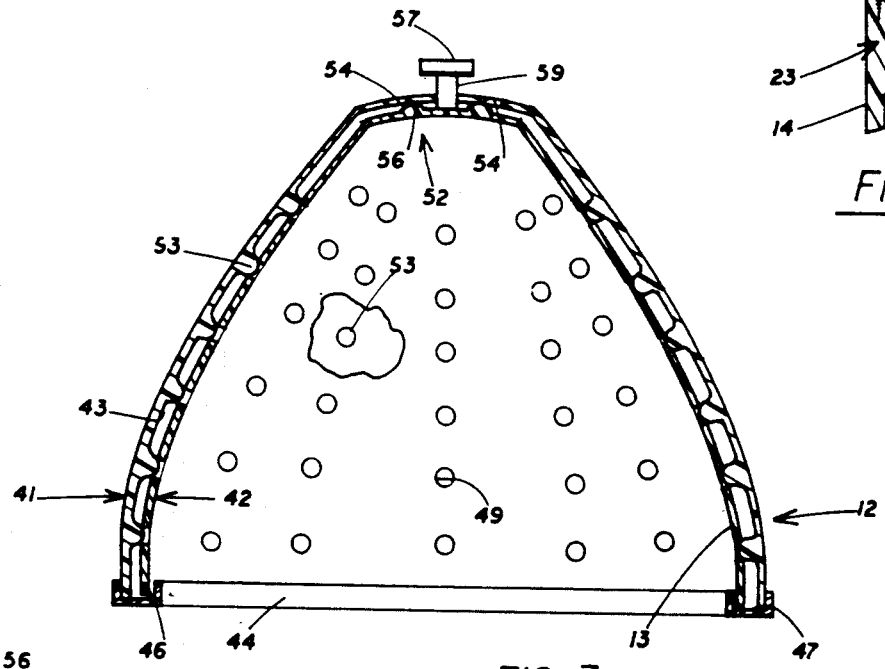
FIG. 3 is a section view of the hood of the hair dryer and processor of the preceding figures.
Figure 4:
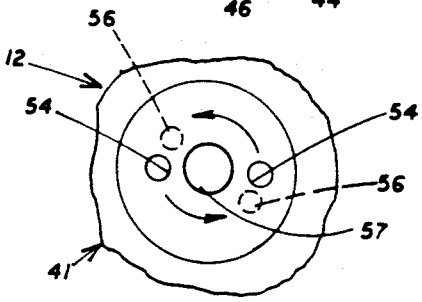
FIG. 4 is a top view of the central region of the hood of FIG. 3.

Referring now to FIGS. 2, 3 and 4, the hood 12 of this embodiment has a dome shaped outer wall 41 and an inner wall 42 of similar configuration but which is of smaller size in order to form a heated air compartment 43 between the two walls. The inner wall 42 defines the hair drying and processing chamber 13. Inner wall 42 is retained within outer wall 11 in a nesting relationship with the outer wall by a circular channel member 44 which is secured to the bottom of the outer wall in coaxial relationship with the outer wall. The lower edge 46 of inner wall 42 extends into the upwardly facing trough 47 of channel member 44 and rests on the floor of the trough. This construction enables rotational turning of inner wall 42 relative to the outer wall 41 for purposes which will hereinafter be described.

During the hair drying mode of operation, a flow of heated air from compartment 43 is delivered to the hair drying chamber 13 through a plurality of apertures 49 in inner wall 42. Aperatures 49 are spaced apart and situated at different circumferential and vertical locations around chamber 13 to distribute the air flow between different regions of the patrons hair.

In order to switch from the hair drying mode of operation to the radiant heating mode of operation, hood 12 is further provided with flow control means 51 for selectively blocking at least a portion of the heated air flow from head receiving chamber 13 and with flow exhaust means 52 for venting the blocked air flow from the hood 12 at a location that is outside of the chamber.

In this embodiment, the flow control means 51 includes a a plurality of spaced apart projections 53 which extend inward from outer wall 41 and which bear against the inner wall 42. Projections 53, which may be integrally formed on the outer wall 41, are positioned to register with and block apertures 49 when the inner wall 42 is turned to a particular angular orientation relative to the outer wall. Turning of the inner wall away from that particular orientation unblocks the apertures 49 and re-establishes the hair drying mode of operation At least one and preferably all of outer wall 41, projections 53 and inner wall 42 are preferably formed of resilient material and the projections have rounded ends which enter into apertures 49 when inner wall 42 is at the above described angular orientation. This causes the inner wall 42 to seat at the radiant heating orientation with a snap action, inhibits drifting of the inner wall out of that orientation and provides for tight sealing of the apertures during the radiant heating operation.

Outer wall 41 has one or more air flow exhaust openings 54, there being two such openings situated at diametrically opposite locations at the top of the wall in this embodiment of the invention. The flow exhaust means 52 of this embodiment includes a pair of protuberances 56 on the top of the inner wall 41. Protuberances 56 are positioned to be away from exhaust openings 54 when the inner wall 42 is turned to the above described radiant heating angular orientation and to register with and block the exhaust openings when the inner wall is turned away from that angular orientation and into a second angular orientation that establishes the hair drying mode of operation. Protuberances 56 preferably have rounded ends and enter into openings 54 with a snap action in a manner similar to that previously described with respect to the flow control projections 53.

Turning of inner wall 42 between the two angular orientations for the above described purposes is facilitated by a circular handle 57 situated above the center of hood 12. A stem 59 extends from handle 57 through the center of the top of hood 12 and is secured to the center of the top of inner wall 42.

In operation, the blower hair dryer mode of operation is established by turning inner wall 42 to the angular orientation at which apertures 49 are unblocked and exhaust openings 54 are closed by protuberances 56. A distributed flow of heated air from compartment 43 enters chamber 13 through the apertures 49 to produce a vigorous hair drying effect. The radiant heating mode of operation is initiated by turning the inner wall 42 to the orientation at which apertures 49 are blocked by projections 53 and exhaust openings 54 are unblocked. No air flow into chamber 13 occurs under that condition but the the diverted air flow continues to heat the inner wall 42. This causes the inner wall to radiate heat to the hair of a person undergoing hair treatment without the physical disturbance of the hair and rapid drying that are brought about by a heated air flow.

Figure 5:
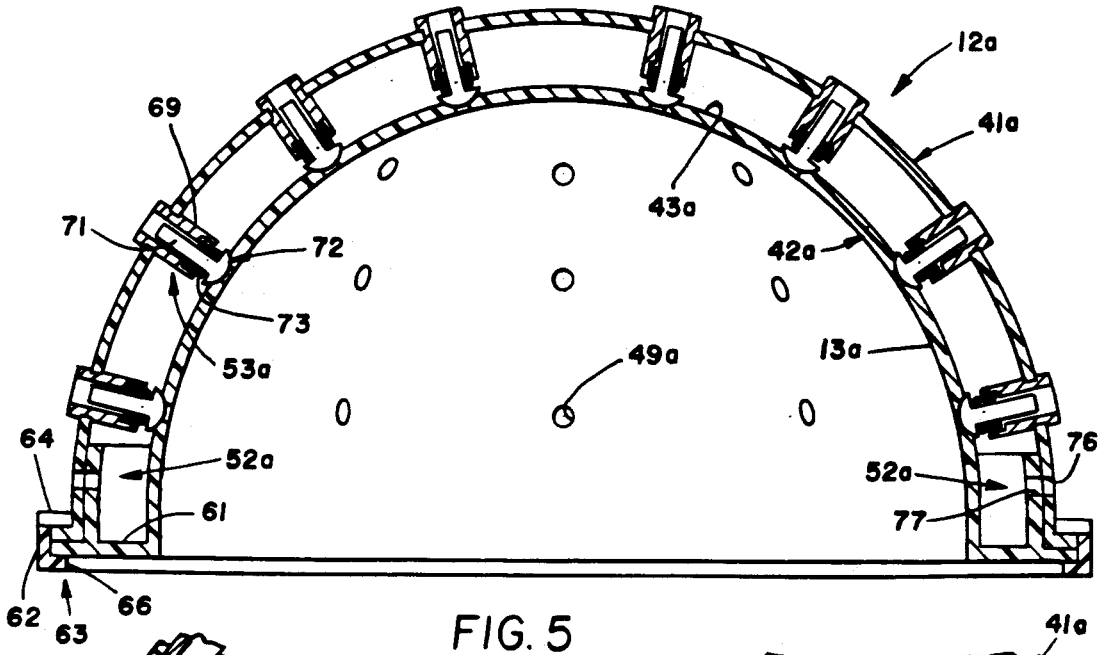
FIG. 5 is an elevation section view of the hood of a hair dryer and processor illustrating a second embodiment of the invention.
Figure 6:
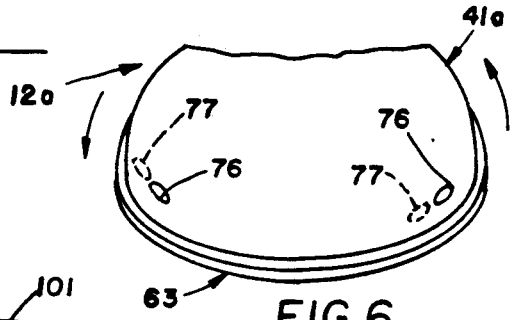
FIG. 6 is a perspective view of the lower region of the hair dryer and processor hood of FIG. 5.

The construction of hood 12 may take various other forms while accomplishing the same advantageous results. FIGS. 5 and 6, for example, depict a second embodiment of the invention in which the hood **12*a* again has an outer wall 41*a* and a smaller inner wall 42*a* which walls are hemispheres in this example and which are again spaced apart to form a heated air compartment 43*a* between the two walls. Inner wall 42*a* has spaced apart apertures 49*a*, similar to those of the previously described embodiment, for selectively transmitting a distributed flow of heated air from compartment 43*a* into the hair treating chamber 13*a*** during the hair drying mode of operation.

Inner wall **42*a* is turnable relative to outer wall 41*a* and has a flange 61 at its base that extends under another flange 62 that extends outward from the bottom of the outer wall. The inner wall 42*a* is held in place by a circular channel shaped band 63 which is formed by an upper member 64 that overlaps flange 62 and a lower member 66 of angled cross section that is secured to the inner wall flange 61. Turning of the inner wall 42*a*, to select the hair drying mode of operation or the radiant heating mode, is accomplished by grasping and rotating band 63**.

In this embodiment, the projections **53*a* which seat in apertures 49*a* at the radiant heating orientation of inner wall 42*a* are spring biased assemblies having first and second telescoping members 69 and 71 respectfully. Members 69 are tubular and extend from outer wall 41*a* towards the apertures 49*a* of the inner wall 42*a*. Members 71 are rods which extend out of the tubular members 69 and which have enlarged rounded ends 72 that seat in the apertures 49*a* when the inner wall 42*a* is turned to the radiant heating position. Helical compression springs 73, which are coaxial with members 69 and 71, urge the enlarged ends 72 of members 71 against the inner wall 42*a*. This provides a strong snap action seating and detenting effect when the inner wall 42*a*** is turned to the radiant heating position.

The flow exhaust means **52*a* of this embodiment of the invention includes an annular member 74 that extends a distance up from inner wall flange 61 and which is coaxial with the outer wall 41*a* and in sliding contact with the wall. Outer wall 42*a* has a series of air flow exhaust passages 76 spaced apart around the circumference of the lower portion of the wall and annular member 74 has a similar series of passages 77. Passages 76 and 77 are located to be in register with each other when the inner wall 42*a* is turned to the radiant heating position at which apertures 49*a* are blocked by protuberances 53*a***.

Thus, as in the previously described embodiment, turning of inner wall **42*a* to the radiant heating position stops the flow of heated air into the hair treatment chamber 13*a*** and vents the flow at an external location.

Components of the hair drying and processing apparatus **11*a* that are not shown in FIGS. 5 and 6** may be similar to the corresponding components of the first embodiment of the invention.

Figure 7:
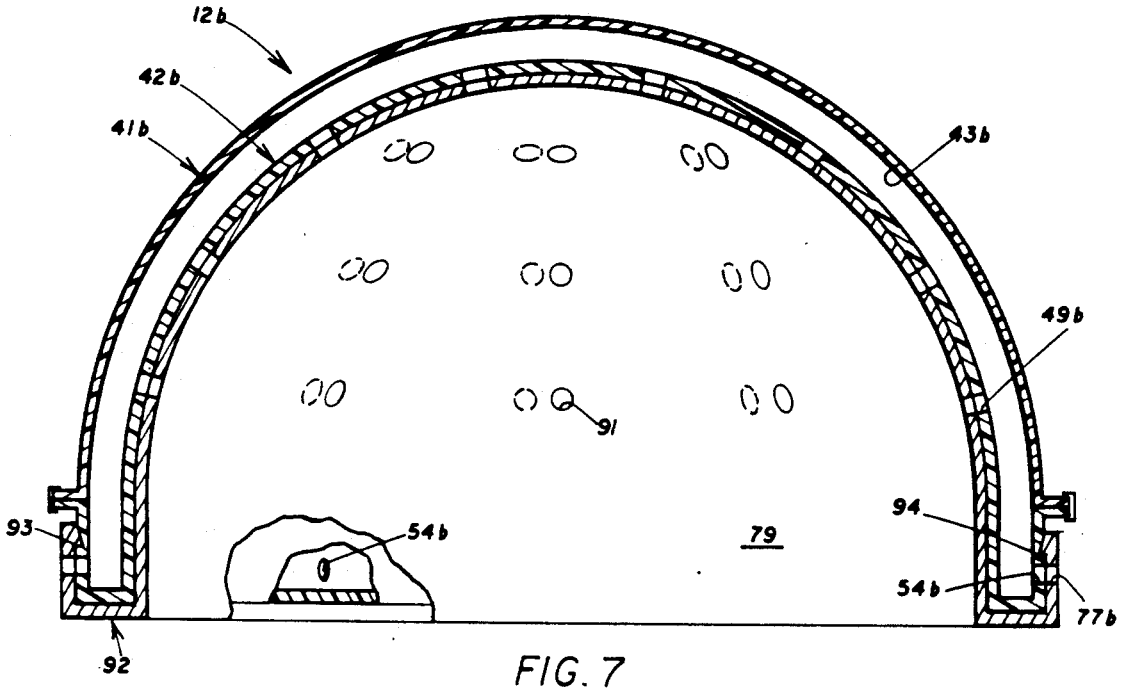
FIG. 7 is a partially broken out elevation section view of the hood of a hair dryer and processor in accordance with a third embodiment of the invention.
Figure 8:
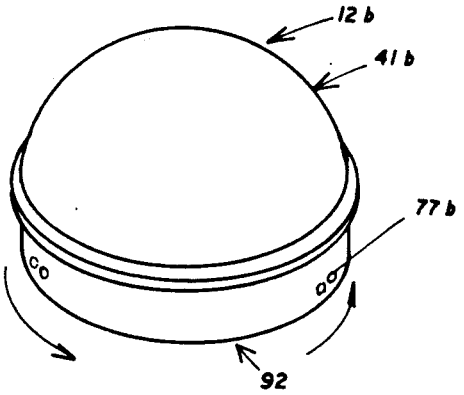
FIG. 8 is a perspective view of the hair dryer and processor hood of FIG. 7.

FIGS. 7 and 8 depict still another embodiment in which the inner wall **42*b* of the hood 12*b* is joined to the outer wall 41*b* at the bottom of the heated air compartment 43*b* and is not rotatable. Switching between the hair drying mode and the radiant heating mode is accomplished by providing an rotatable inner liner 79 which has a hemispherical configuration conform to the shape of the inner wall 42*b* and which fits against the inner wall. Liner 79 has a plurality of air passages 91 which register with the apertures 49*b* of inner wall 42*b* when the liner 79 is turned to a hair drying position. Turning the liner away from that position as depicted by dashed lines in FIGS. 7 and 8, blocks the apertures 49*b*** and establishes the radiant heating mode of operation.

Liner 79 has a flange 92 at its lower end that extends outward and then upward along the lower portion of the outer surface of outer wall 41*b*. To hold the liner 79 in place while enabling rotational motion of the liner, a ramp shaped projection 93 at the upper end of flange 92 seats in a conforming groove 94 in the outer wall 41*b*. The liner is formed of material that is sufficiently resilient to enable the flange 92 to deflect slightly as the liner is being inserted into the hood 12*b*. The resiliency causes projection 93 to seat in groove 94 with a snap action when the liner 79 is fully inserted.

The heated air flow is vented from compartment 43*b* when the liner 79 is at the radiant heating position through a series of spaced apart exhaust openings 54*b* in the lower portion of outer wall 41*b* which openings are in register with a similar series of exhaust passages 77*b* in flange 92 when the liner 79 is turned to the radiant heating position. Flange 92 blocks the exhaust openings 54*b* when liner 79 is turned away from that position.

The liner 79 of this embodiment of the invention may be positioned to only partially obstruct the apertures 49*b* and thereby provide an intermediate mode of operation in instances where that is beneficial to a particular type of hair treatment.

The embodiments of the invention that have been described up to this point have hoods with structural features that are not found in conventional hair dryer hoods. The invention also enables operation of a conventional hood as a radiant heater with little or no structural modification of the hood.

Figure 10:
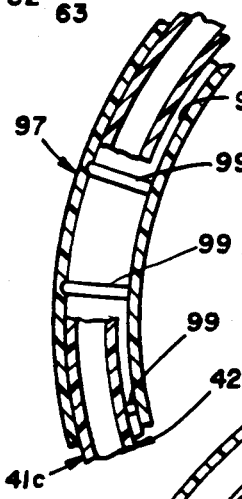
FIG. 10 is section view taken along line 10—10 of FIG. 9.
Figure 9:
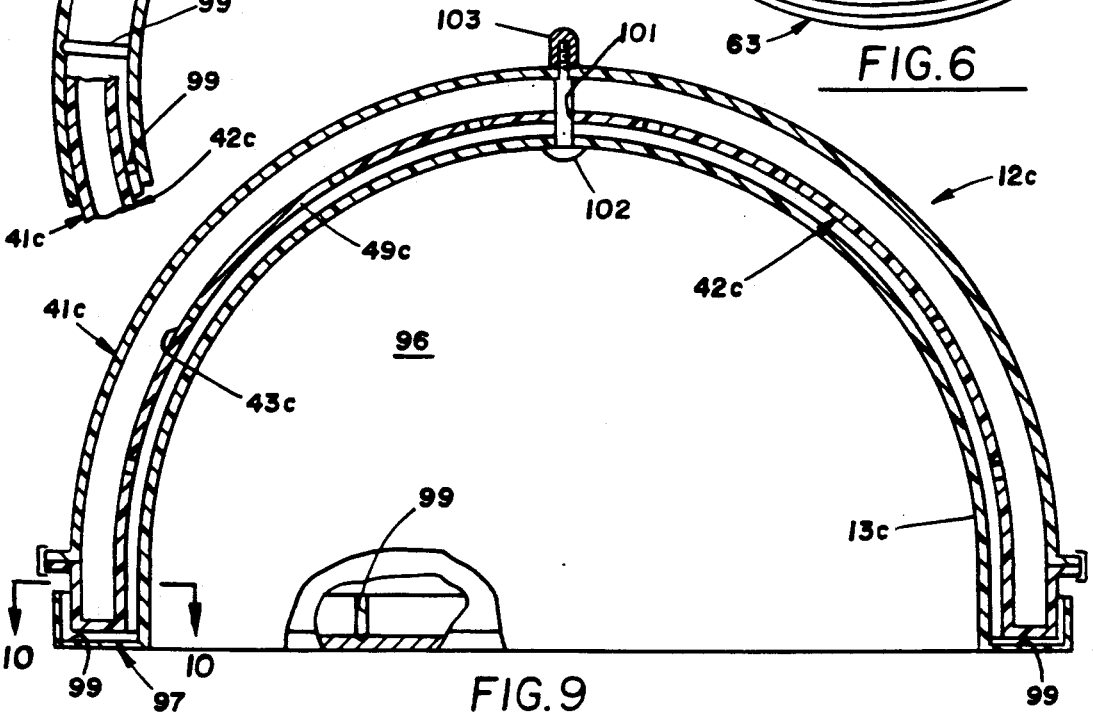
FIG. 9 is a partially broken out perspective view of another hair dryer and processor in accordance with a fourth embodiment of the invention.

Referring to FIGS. 9 and 10, this may be accomplished with an inner liner 96 which is disposed within the hood 12*c* and which is proportioned to be slightly spaced apart from the dome shaped inner wall 42*c* of the hood. A flange 97 extends outward at the base of the heated air compartment 43*c* and then upward for a small distance along the outside surface of the outer wall 41*c*. A series of air flow venting grooves 99 extend radially outward along the upper surface of flange 97 and then upward along the vertical portion of the flange, the grooves being spaced apart and situated at equiangular intervals around the flange.

Liner 96 is imperforate and thus intercepts the flow of heated air which passes through the apertures 49*c* of the inner wall 42*c* of the hood. The intercepted flow travels downward between inner wall 42*c* and liner 96 and is vented by grooves 99 at a location that is outside of the hair processing chamber 13 which is defined by the inner surface of the liner in this embodiment.

The flow of heated air between inner wall 42*c* and liner 96 heats the liner and this causes heat to be radiated towards the hair that is being processed in chamber 13*c*.

Flange 97 is preferably proportioned to frictionally grip the lower end portion of the hood 12*c* in order to hold the liner 96 in place while enabling easy removal when the hood is to be used for hair drying. Securing of liner 96 may be augmented by drilling a passage 101 through the center of the top of the hood and the corresponding location on the liner. A bolt 102 may then be inserted through the liner 96 and the top of the hood 12*c* and a nut 103 may be engaged on the bolt to secure the top of the liner in place.

While the invention has been described with respect to certain specific embodiments for purposes of example, many variations and modifications of the construction are possible and it is not intended to limit the invention except as defined in the following claims.

I claim:

1. Hair drying apparatus having a hood with a dome shaped chamber therein that is adapted to receive the upper portion of a person's head, said hood having a heated air compartment therein which is situated outward from said head receiving chamber and having a plurality of spaced apart apertures for delivering a flow of heated air from said compartment to said head receiving chamber at a plurality of different locations around said chamber including locations at the front and back and sides of said chamber, wherein the improvement comprises:

flow control means for selectively blocking said heated air flow from said head receiving chamber at each of said aperture locations, and flow exhaust means for enabling a continued flow of said air within said compartment when air flow into said head receiving chamber is blocked which flow exhaust means vents the air flow from said hood at a location that is outside of said head receiving chamber, whereby the flow of heated air to said person's head may be selectively suppressed while said hood continues to be heated by said air flow therein and operates as a radiant heater for hair processing operations.

2. Hair drying apparatus having a hood with a dome shaped chamber therein that is adapted to receive the upper portion of a person's head, said hood having a heated air compartment therein which is situated outward from said head receiving chamber and wherein said hood has an outer wall and an inner wall which is spaced from said outer wall to form said heated air compartment therebetween, said inner wall having a plurality of spaced apart apertures at a plurality of different locations around said chamber, said apparatus further having means for delivering a flow of heated air from said compartment to said head receiving chamber through said apertures, wherein the improvement comprises:

flow control means for selectively blocking at least a portion of said heated air flow from said head receiving chamber, and wherein said inner wall of said compartment is a component of said flow control means and is movable relative to said outer wall between a first position at which said apertures are open and a second position at which said apertures are at least partially blocked, flow exhaust means for venting said blocked air flow from said hood at a location that is outside of said head receiving chamber, whereby the flow of heated air to said person's head may be selectively suppressed while said hood continues to be heated by said air flow and operates as a radiant heater for hair processing operations.

3. Hair drying apparatus having a hood with a dome shaped chamber therein that is adapted to receive the upper portion of a person's head, said hood having a heated air compartment therein which is situated outward from said head receiving chamber and means for delivering a flow of heated air from said compartment to said head receiving chamber at a plurality of different locations around said chamber, wherein the improvement comprises:

flow control means for selectively blocking at least a portion of said heated air flow from said head receiving chamber, and flow exhaust means for venting said blocked air flow from said hood at a location that is outside of said head receiving chamber, whereby the flow of heated air to said person's head may be selectively suppressed while said hood continues to be heated by said air flow and operates as a radiant heater for hair processing operations, wherein said hood has an outer wall and an inner wall which is spaced from said outer wall to form said heated air compartment therebetween, said inner wall having a plurality of spaced apart apertures through which said air flow is transmitted from said compartment to said head receiving chamber, and wherein said flow control means enables selective obstruction of said apertures and wherein said inner wall is a component of said flow control means and is movable relative to said outer wall between a first position at which said apertures are open and a second position at which said apertures are at least partially blocked and wherein said hood has at least one opening through which said flow exhaust means releases said blocked air flow at said location that is outside of said chamber and wherein said flow exhaust means includes at least one closure on said inner wall positioned to block said opening when said inner wall is at said first position thereof and to open said opening when said inner wall is at said second position thereof.

4. Hair drying apparatus having a hood with a dome shaped chamber therein that is adapted to receive the upper portion of a person's head, said hood having a heated air compartment therein which is situated outward from said head receiving chamber and means for delivering a flow of heated air from said compartment to said head receiving chamber at a plurality of different locations around said chamber, wherein the improvement comprises:

flow control means for selectively blocking at least a portion of said heated air flow from said head receiving chamber, and flow exhaust means for venting said blocked air flow from said hood at a location that is outside of said head receiving chamber, whereby the flow of heated air to said person's head may be selectively suppressed while said hood continues to be heated by said air flow and operates as a radiant heater for hair processing operations, wherein said hood has an outer wall and an inner wall which is spaced from said outer wall to form said heated air compartment therebetween, said inner wall having a plurality of spaced apart apertures through which said air flow is transmitted from said compartment to said head receiving chamber, and wherein said flow control means enables selective obstruction of said apertures and wherein said inner wall is a component of said flow control means and is movable relative to said outer wall between a first position at which said apertures are open and a second position at which said apertures are at least partially blocked and wherein said inner wall is turnable relative to said outer wall between first and second angular positions relative to said outer wall, and wherein said outer wall has projections which extend towards said inner wall, said projections being positioned to block air flow through said apertures when said inner wall is turned to said second angular position thereof and to leave said apertures unobstructed when said inner wall is at said first angular position thereof.

5. The apparatus of claim 4 wherein said projections extend into said apertures when said inner wall is at said second angular position thereof, at least one of said projections, said outer wall and said inner wall being formed of resilient material to enable turning of said inner wall between said angular positions thereof.

6. The apparatus of claim 4 wherein said projections each have first and second telescoping members, said first member being secured to said outer wall and wherein said second member extends to said inner wall and wherein each of said projections further has a spring positioned to urge said second member towards said inner wall.

7. The apparatus of claim 4 wherein said projections have distal ends that extend into said apertures when said inner wall is at said second angular position thereof, and wherein said inner ends have a convex-rounded configuration.

8. The apparatus of claim 4 wherein said outer wall has at least one exhaust opening therein and wherein said flow exhaust means includes at least one protuberance on said inner wall that is positioned to obstruct said exhaust opening when said inner wall is at said first angular position thereof and to open said exhaust opening as said inner wall is moved to said second angular position thereof.

9. The apparatus of claim 1 wherein said hood has an outer wall and an inner wall which is spaced from said outer wall to form said heated air compartment therebetween, said inner wall having a plurality of spaced apart apertures through which said air flow is transmitted from said heated air compartment to said head receiving chamber, wherein said flow control means includes an inner liner situated inside said inner wall, said inner liner being turnable relative to said inner wall and having a plurality of air passages located to register with said plurality of apertures of said inner wall when said liner is turned to a first angular position relative to said inner wall and to be out of register with said apertures when said liner is turned to a second angular position.

10. The apparatus of claim 9 wherein said hood has an airflow exhaust opening communicating with said heated air compartment and situated outside said head receiving chamber and wherein said flow exhaust means includes an extension on said liner positioned to block said exhaust opening when said liner is turned to said first angular position thereof and to open said exhaust opening when said liner is turned to said second angular position thereof.

11. The apparatus of claim 9 wherein said hood has a an exterior surface and wherein said liner has a lower end portion which extends outward beneath said hood and upward along said exterior surface thereof, one of said lower end portion and said hood having an indentation therein and the other thereof having a projection located to seat in said indentation when said liner is disposed in said head receiving chamber, at least one of said hood and said liner end portion being formed of resilient material to enable snap engagement of said liner with said hood.

12. The apparatus of claim 1 wherein said hood has an outer wall and a spaced apart inner wall between which said heated air compartment is situated, said inner wall having a plurality of spaced apart apertures situated at said plurality of different locations through which said heated air flow may be transmitted to said head receiving chamber, and wherein said flow control means includes a fluid impervious upper portion of a dome shaped liner that is disposed in said head receiving chamber in spaced apart relationship with said inner wall of said hood, and wherein said flow exhaust means includes a flange extending outward from said liner below said hood, at least portions of said flange being spaced from said hood to provide at least one exhaust flow passage that extends to said location that is outside of said head receiving chamber.

13. Hair drying and processing apparatus comprising:

a hood having an outer wall and an inner wall which is spaced apart therefrom to form a heated air compartment therebetween and to form a chamber in said hood for receiving the upper portion of a person's head, said inner wall having a plurality of spaced apart apertures situated at different locations around said chamber for transmitting a flow of heated air from said compartment to said chamber, said inner wall being turnable relative to said outer wall, said outer wall having a plurality of inwardly directed projections in said compartment located to close said apertures when said inner wall is turned to a first position and to open said apertures when said inner wall is turned away from said first position, means for delivering a flow of heated air to said compartment, and means for venting heated air from said compartment at a location outside of said head receiving chamber during periods when said inner wall is turned to said first position thereof.

* * * * *